United States Patent [19]

Gierek et al.

[11] 4,142,011

[45] Feb. 27, 1979

[54] METHOD OF PRODUCING COATINGS OF COPPER ALLOY ON FERROUS ALLOYS

[75] Inventors: Adam Gierek; Lech Bajka; Malgorzata Machnicka, all of Katowice, Poland

[73] Assignee: Politechnika Slaska im. Wincentego Pstrowskiego, Gliwice, Poland

[21] Appl. No.: 713,604

[22] Filed: Aug. 11, 19761420118310034274 33

[51] Int. Cl.[2] ..... C23C 1/10; C23C 1/04

[52] U.S. Cl. ..... 427/431; 427/433; 427/383 D; 428/677

[58] Field of Search ..... 427/431, 432, 329, 383 D; 428/676, 677; 148/15; 75/160, 154

[56] References Cited

U.S. PATENT DOCUMENTS

| | | | |
|---|---|---|---|
| 25,291 | 8/1859 | Thoss | 427/431 |
| 118,372 | 8/1871 | Lavroff | 75/154 |
| 1,430,650 | 10/1922 | Herman | 148/15 X |
| 1,441,567 | 1/1923 | Fink | 75/160 |
| 1,539,260 | 5/1925 | Jacobs | 75/160 |
| 2,129,197 | 9/1938 | Bryant | 75/154 |
| 2,195,435 | 4/1940 | Silliman | 75/154 |
| 3,203,824 | 8/1965 | McQuaid | 427/432 |

FOREIGN PATENT DOCUMENTS

| | | | |
|---|---|---|---|
| 1194392 | 6/1970 | United Kingdom | 427/431 |

OTHER PUBLICATIONS

Handbook of Chemistry and Physics, 54th ed., 1973, p. D-149.

*Primary Examiner*—Ralph S. Kendall
*Attorney, Agent, or Firm*—Haseltine, Lake & Waters

[57] ABSTRACT

A method of producing coatings of copper alloys in hot-dip process on workpieces made of ferrous alloys comprising dipping the workpieces to be coated into baths of molten alloys of Cu with Si, Sn, Al, P, In, Ca, Be, having a temperature within the range of 700°-1100° C., with a single-stage or a two-stage movement, the workpieces then being held in the bath for from 15 seconds to 60 minutes and taken out of the bath and cooled at any desirable rate.

8 Claims, No Drawings

METHOD OF PRODUCING COATINGS OF COPPER ALLOY ON FERROUS ALLOYS

This invention relates to producing coatings of copper alloys on ferrous alloys in a hot-dip process.

Known are methods of obtaining copper alloys on workpieces of ferrous alloys which, however, in most cases do not secure the homogeneity, uniformity and continuity of the coating. The most often used methods of producing adhesion coatings of copper alloys are those consisting in of spraying and plating.

One of the known methods consists of spraying onto the steel workpiece, previously blast cleaned and degreased, a jet of melted powder of tin bronze containing 90% of copper and 10% of tin. As a result of said operation a layer is obtained, adhering to the base, characterized by considerable porosity and inequality.

There is also known a method of coating the surfaces of workpieces having an uncomplicated configuration with foils of copper or copper/alloys in the fashion of a plastic working process. This method, known as plating, produces adhesion coatings which are easily exfoliated, thereby significantly reducing their corrosion resistance. It cannot also be used for workpieces having complicated forms.

The known methods of coating with copper or copper alloys involve numerous disadvantages. They do not produce diffusion coatings but only thin layers adhering to the base by adhesion forces. Most significantly, the known methods do not admit performing heat treatment operations simultaneously with the production of the coating, for improving the mechanical properties of the copper coated workpieces. Said methods employ expensive and complicated equipment, the process itself being as a rule very time consuming. The obtained coatings are thin thus additionally reducing their corrosion resistance. The adhesive nature thereof also does not admit use of the workpieces coated in this way under conditions of high loading and intensive friction. They are also not suited for quick and efficient coating of fine workpieces of complicated shape in mass production.

The object of the invention is to provide a method of obtaining diffusion coatings of copper alloys in hot-dip process on workpieces made of ferrous alloys, with simultaneous heat treatment of the products. Said coatings are able to provide a notable increase in the corrosion resistance of the products, especially in higly aggressive environments, mainly in water and sea environment, as well as in hot industrial waters containing certain contaminations, such as, for instance, chlorides or compounds of sulphur. Said coating can be also applied on wear resistant parts of bearings and on elements of other friction connections.

The method according to the invention comprises dipping the workpieces to be coated into a bath of molten alloys of Cu with Sn, Si, Al, P, In, Ga, Be, at a temperature within the range of 700°-1100° C., in a two-stage or single-stage continuous movement, and the workpieces are held therein for 15 sec. up to 60 minutes, whereafter they are taken out of the bath and cooled at any rate. The dipping of the workpieces into the bath is performed in a single stage, or in two stages, in which the workpiece is dipped into the bath and held beneath the surface whereafter it is introduced into a deeper layer of the bath.

The method according to the invention, due to selection of low fusible copper alloys with silicon, tin, aluminium and phosphorus, provides an economic coating of products having complicated shapes, in a relatively short time of dipping in a bath of fused metal.

For instance, a coating of Cu-Si alloys can be obtained by dipping steel workpieces, with previously prepared surface, into a bath of fused metal containing 84% Cu and 16% Si, at a speed of 5 m/min, holding the workpieces just below the surface of the bath for a time less than one minute, and then immersing the workpiece deeper into the bath, adjacent to the bottom of the crucible. After the products thereat for 10 minutes, the products are brought to the surface at a speed of 1 m/min and slowly cooled in the air. The temperature of the molten metal is 850° C.

The advantages of the method according to the invention consist mainly in its simplicity and in obtaining in short time uniform and continuous coatings on workpieces having any complicated shapes, with simultaneous heat treatment in the course of forming the coating and after removing the workpieces from the bath. The products coated by the method according to the invention are characterized by increased corrosion resistance and improved mechanical properties.

EXAMPLE I

A workpiece made of low-carbon steel containing 0.1% C and having a ferritic-pearlitic structure, was dipped after preparation of its surface, at a rate of 5 m/min into a bath containing 75% Cu and 25% Sn, at a temperature of 850° C. The dipped workpieces were held below the surface of the bath for 1 minute and then immersed at a rate of 2 m/min to a greater depth in the bath, where they are held for 15 minutes. After this period the workpieces were brought to the surface at a rate of 1 m/min and slowly cooled in the air.

EXAMPLE II

Lengths of steel tubes were dipped in axial direction, at a rate of 0.5 m/min into a bath containing 84% Cu and 16% Si, at a temperature of 860° C. Thereafter the workpieces were held in said bath for 3 minutes, and then taken out at a rate of 3 m/min.

What is claimed is:

1. A method of producing a coating of a copper alloy on a workpiece made of ferrous alloy, said method comprising dipping the ferrous alloy workpiece to be coated into a molted bath of 75-84% copper with the balance being Si or Sn at a temperature of about 850° C., holding said workpiece in said bath for 15 seconds to 60 minutes to form the copper alloy coating thereon and then removing the workpiece from the bath.

2. A method as claimed in claim 1 wherein said workpiece is held below the surface of the bath at an upper position in the bath and then immersed more deeply into the bath near the bottom thereof before removal.

3. A method as claimed in claim 2 wherein said workpiece is removed from said bath at a rate of 1m/min,

4. A method as claimed in claim 2 wherein said workpiece is immersed more deeply into said bath at a rate of 2m/min.

5. A method as claimed in claim 4 wherein said workpiece is held for 1 minute below the surface of said bath and for 15 minutes after being more deeply immersed.

6. A method as claimed in claim 1 wherein said workpiece is held in the bath for 3 minutes and removed at a rate of 3m/min.

7. A method as claimed in claim 1 wherein said workpiece is dipped into said bath at a rate of 0.5 to 3m/min.

8. A method as claimed in claim 7 wherein the bath temperature, the time of immersion of said workpiece in the copper alloy bath as well as a rate of removing said workpiece from said bath are correlated for forming coatings as well as heat treatment operations carried out simultaneously with the forming in the copper alloy bath.

* * * * *

UNITED STATES PATENT AND TRADEMARK OFFICE

CERTIFICATE OF CORRECTION

PATENT NO. : 4,142,011

DATED : February 27, 1979

INVENTOR(S) : Adam Gierek et al.

It is certified that error appears in the above-identified patent and that said Letters Patent are hereby corrected as shown below:

On the cover sheet insert Item (30) Priority Data

-- Poland P- 182831 August 19, 1975

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*